US008215417B2

(12) United States Patent
Annaiyappa et al.

(10) Patent No.: US 8,215,417 B2
(45) Date of Patent: Jul. 10, 2012

(54) METHOD, DEVICE AND SYSTEM FOR DRILLING RIG MODIFICATION

(75) Inventors: Pradeep Annaiyappa, Houston, TX (US); Scott Boone, Houston, TX (US); Brian Ellis, Spring, TX (US); Beat Kuttel, Spring, TX (US); John Scarborough, Houston, TX (US)

(73) Assignee: Canrig Drilling Technology Ltd., Houston, TX (US)

( * ) Notice: Subject to any disclaimer, the term of this patent is extended or adjusted under 35 U.S.C. 154(b) by 0 days.

(21) Appl. No.: 11/668,388

(22) Filed: Jan. 29, 2007

(65) Prior Publication Data

US 2008/0173480 A1 Jul. 24, 2008

Related U.S. Application Data

(60) Provisional application No. 60/886,259, filed on Jan. 23, 2007.

(51) Int. Cl.
*E21B 44/00* (2006.01)

(52) U.S. Cl. ..... 175/24; 175/40

(58) Field of Classification Search ..... 175/24, 175/25, 26, 38, 40

See application file for complete search history.

(56) References Cited

U.S. PATENT DOCUMENTS

| | | | | |
|---|---|---|---|---|
| 4,819,730 | A * | 4/1989 | Williford et al. | 166/355 |
| 6,192,282 | B1 | 2/2001 | Smith et al. | |
| 6,892,812 | B2 | 5/2005 | Niedermayr et al. | |
| 6,907,375 | B2 * | 6/2005 | Guggari et al. | 702/113 |
| 6,944,547 | B2 * | 9/2005 | Womer et al. | 702/7 |
| 7,128,167 | B2 | 10/2006 | Dunlop et al. | |
| 2002/0060093 | A1 | 5/2002 | Womer et al. | |
| 2005/0134284 | A1 * | 6/2005 | Hoff et al. | 324/511 |

OTHER PUBLICATIONS

Aldred et al, "Changing the Way We Drill", Oilfield review, pp. 42-49, Spring 2006.*

ISA/US, "International Search Report," Application No. PCT/US2008/051254, Aug. 8, 2008, 3 pages.

ISA/US, "Written Opinion," Application No. PCT/US2008/051254, Aug. 8, 2008, 7 pages.

* cited by examiner

*Primary Examiner* — Brad Harcourt

(74) *Attorney, Agent, or Firm* — Haynes and Boone, LLP

(57) ABSTRACT

A method, device and system for augmenting a traditional drilling or workover rig with automated operational, monitoring and reporting systems. The automation system comprises integratable components of various automated operational systems, combined in a device easily adapted to install into the operational area of a drilling or workover rig, wherein the automated operational systems are dynamically selectable either or both locally or remotely.

29 Claims, 6 Drawing Sheets

METHOD, DEVICE AND SYSTEM FOR DRILLING RIG MODIFICATION

CROSS-REFERENCE TO RELATED APPLICATIONS

This application claims the benefit of provisional Application No. 60/886,259, filed Jan. 23, 2007, entitled "Method, Device and System for Drilling Rig Modification," which is hereby incorporated by reference.

BACKGROUND

The present disclosure relates generally to devices and methods for either or both retrofitting and augmenting a traditional drilling or workover rig, and more specifically to automating the operations and control systems. In recent years, innovations that incorporate electronics and computerization have permitted the development of automated systems that can be monitored and operated remotely.

Most modern drilling and workover rigs now house a variety of these automated systems in the form of a fully integrated drilling control system, offering the operators the ability to more easily monitor, document, and control the varied systems with the assistance of computerized terminals and digital displays. Examples of these might be rigs based on the "Cyberbase" system, provided by National Oilwell Varco, Houston, Tex., or the PACE System, provided by Academy Electric, Calgary, Canada. These types of rig automation and control systems have become very popular over the last few years and are used in many of the new rig constructed. But such systems do not address the needs of the traditional aging global rig fleet base that do not have the integrated automation and control systems, referred herein as "traditional" rigs. In this disclosure a traditional rig may be any system referred to as a "rig" in the industry, including a drilling rig and a workover rig. At present, worldwide, there are in excess of 3100 Rotary Drilling Rigs, and a similar number of Workover Rigs. At the time of this disclosure, less than ten percent of these are of the type that has a fully integrated drilling control system.

Today many tools have been developed that make the task of operating the rig more automated and centralized, especially on the newer automated rigs with fully integrated control systems, where a significant set of the tools are integrated. But on traditional rigs these varied systems, developed by disparate companies, have created a complex operation area, jumbled with output displays and controls. Among other things, the systems and methods of the present disclosure helps this complexity issue by reducing the total number of individual systems, sensors, controls and display installations, by rationalizing, integrating systems and hence simplifying the operational areas and system installations for a traditional rig.

As disclosed, of the rigs in service most are traditional in type. These rigs require manual operation and monitoring of an assortment of drilling systems, unless otherwise augmented with select, discrete automation, control and reporting tools available from a wide range of individual providers. Since traditional rigs represent a sizeable capital investment, and possess valuable operational life, it is economically prudent to continue to employ the traditional rigs in drilling operations.

On a traditional rig, the driller, who is in charge of the drilling crew and operation of the rig during drilling operations, works at a primary control station. It is typical for a driller to keep a desk area from where drilling operations are coordinated and the operational documentation is maintained. The driller's desk is typically referred to as the "Knowledge Box," and is located in a shelter, referred to as the doghouse, on or adjacent to the rig. In most instances, on traditional drilling rigs, the driller's desk has a hinged, sloped lid with a lip at its base, and holds a large International Association of Drilling Contractors ("IADC") drilling tablet, Canadian Association of Drilling Contractors ("CAODC") drilling tablet, or similar well site activity recording tablet. The lid is hinged so the driller can move the tablet off the desk to keep it clean. The desk is usually located under the window to give the driller a good view of the rig floor and is also near the door for quick access. The desktop is usually around forty-eight inches tall, which is a comfortable height for the driller to stand and complete reports. The desk is also frequently used as a repository for miscellaneous items, such as pens, strapping tape, small plumbing fittings, and etcetera.

Space in the doghouse is at a premium. The knowledge box made sense when the driller was tasked with keeping the IADC report current and clean, and when the freestanding mechanical drilling recorder was positioned nearby. A driller is now required to complete his reports on a computer and utilize an electronic drilling recorder, so the reporting functions and mechanical drilling recorder are now replaced by data acquisition and computer systems. Other equipment is becoming computerized, such as the pneumatic autodriller and directional steering controls, and with each new system a new set of sensors, controls is added to the rig equipment and another interface is added to the doghouse and drillers station It would be a valuable addition to the field of art to provide a method of augmenting a traditional rig with automated systems. In order to simplify the retrofitting process, and to take advantage of automated technology, among other advantages, it would be valuable to the field of art to provide a system that may flexibly and dynamically provide such advantages as to integrate multiple automated systems, reduce sensor duplication, reduce the number of controls and control boxes, reduce the number of displays, reduce the space required over discrete automated system installations, reduce time to rig up and rig down, improve overall reliability, improve efficiency, provide more capability for less investment, reduce the controls and interface complexity, and improve standardization of interfaces for the end user.

DETAILED DESCRIPTION

Figure 1:
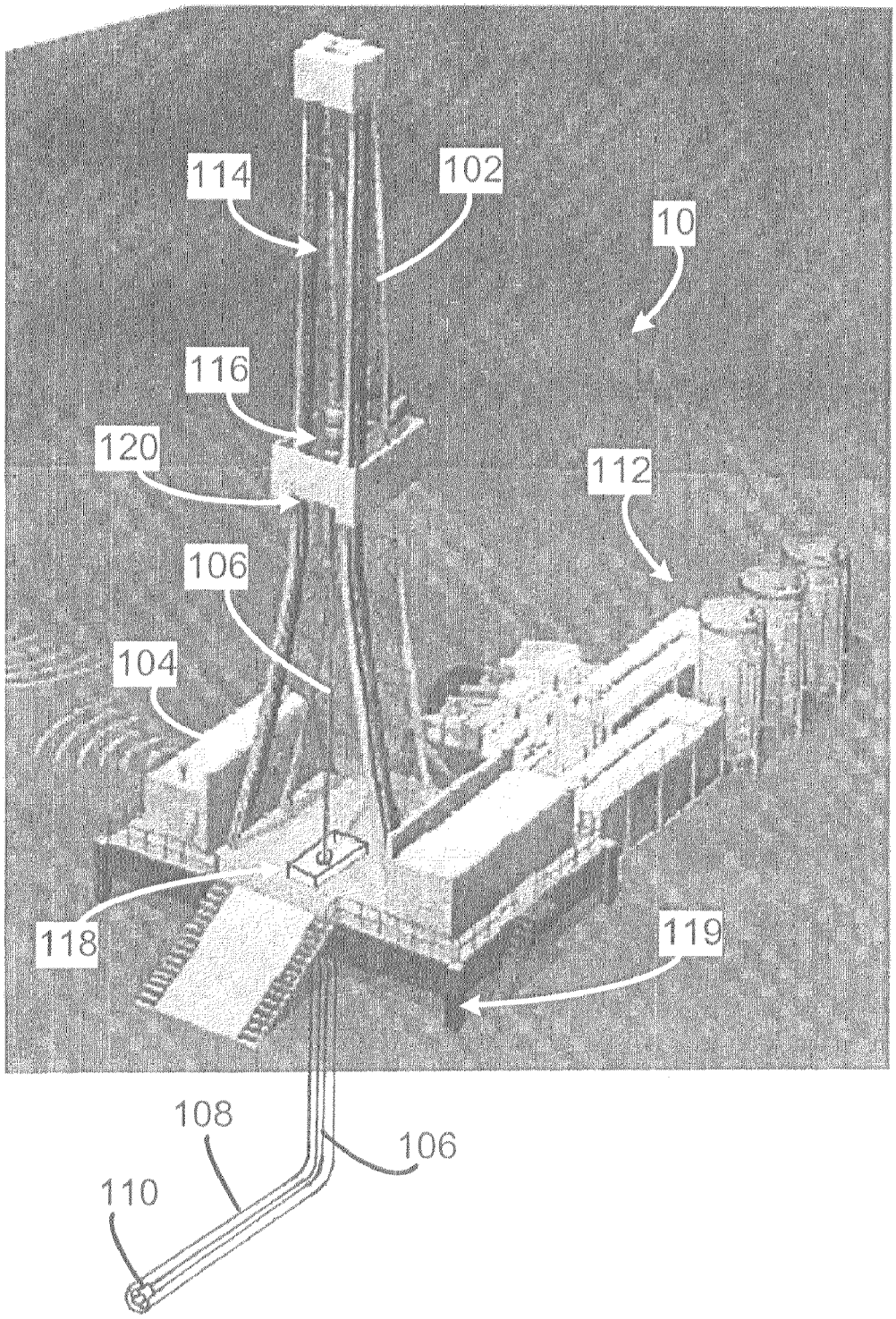
FIG. 1 is a schematic perspective view of a drilling rig depicting some of the integral systems, according to the current disclosure.

For the purposes of promoting an understanding of the principles of the invention, reference will now be made to the embodiments, or examples, illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Referring first to FIG. 1, a typical oil and gas drilling rig 10 is shown having a vertically erect derrick 102 for assembling, positioning, tripping and drilling with a drill string 106. The doghouse 104, adjacent to the derrick 102 provides a convenient location for the driller to coordinate drilling operations. From the doghouse 104, the driller can normally observe the entire rig, including the substructure 119 that supports the pipe handler assembly 114 and the derrick 102, that supports the automated tubular racking system 120, casing running system and the top drive assembly 116, and the drill floor, that houses a floor wrench assembly 118, rotary table and, normally, a drawworks.

The mud system assembly 112 is shown to have mud pits and mud pumps, and further extends onto the derrick 102 in order to supply the mud into the drill string 106. Mud pumps push the mud all the way through the drill string 106 to the drill bit 110, where the mud lubricates the bit and flushes cuttings away. As more mud is pushed through the drill string 106, the mud fills the annulus around the drill string 106, inside the drill hole 108, and is pushed to the surface. At the surface the mud system assembly 112 recovers the mud and separates out the cuttings. The condition of the mud is assessed and additives are replenished as needed to achieve the necessary mud characteristics. Also at the surface a rig has a blow out prevention system to close in the well bore and protect the well site in the event of a kick as well, and a choke manifold and control system to manage pressurized well bore fluid returns and discharges.

On traditional rig 10, the systems described above are controlled through experience and human perceptions. In this disclosure, a workover rig will in most cases be included in the term traditional rig. Automated systems are available to substantially augment the skill of the operators for many of the systems on the rig 10. Sensors and monitors required for the operation of each automated system may be added to the drill string 106, drill bit 110, mud system assembly 112, pipe handler assembly 114, drawworks, rotary table 118, top drive assembly 116, automated tubular racking system 120, casing running system, floor wrench assembly 118, blow out preventors and choke manifold systems and any other drilling equipment/system on site and in use, with the data collected by the sensors and monitors directed to the doghouse 102 for the driller to review. The separate systems generate a substantial volume of data.

The present device and system offers the driller a unitary, integrated system that has an integrated control center that fits in a convenient space within the dog house. Additional displays and interfaces may be provisioned around the rig site as necessary. Typically the convenient space within the dog house is the knowledge box. In the present system, redundant sensors and monitors are eliminated, the automated controllers are consolidated into a single computer system, and outputs are standardized, for either or both transmission locally and remotely from the rig 10. Automated controllers may include such devices as programmable logic controllers ("PLCs"), programmable automation controllers, personal computers and micro controllers. The present device offers integrated assessment, documentation and control of the systems listed above as examples, as well as other systems involved in the operation of an automated drilling rig 10.

Figure 2:
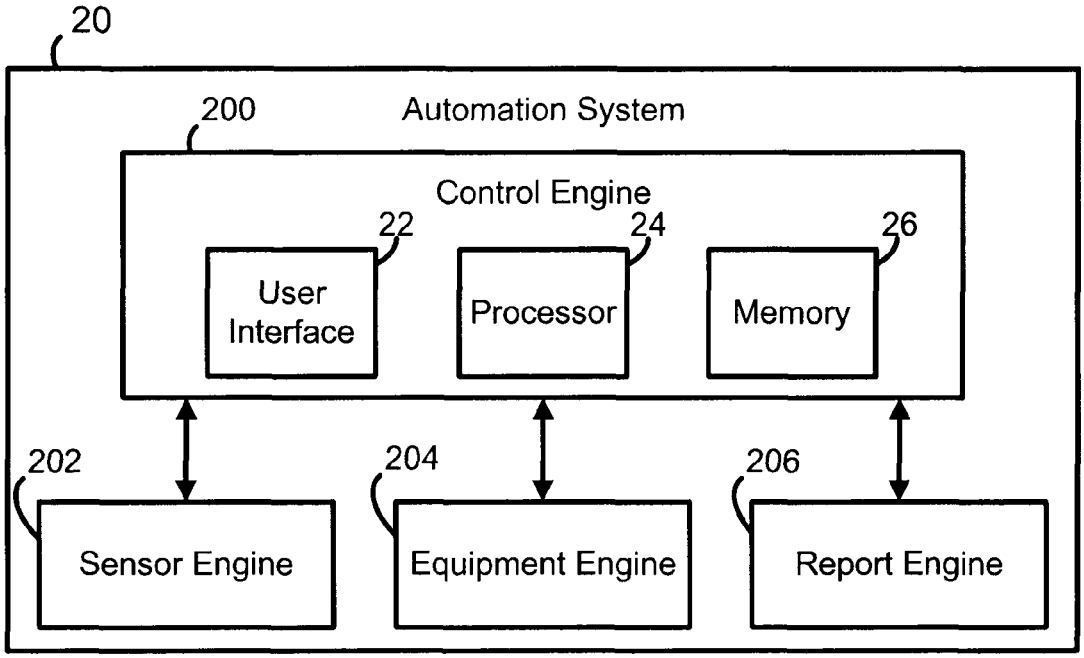
FIG. 2 is a schematic illustration of the functional engines of an exemplary automated system, addable to a traditional rig.

Referring now to FIG. 2, the exemplary automated knowledge box, or "K-Box," automation system 20 is comprised of an integrated control engine 200 that is operably coupled to elements, including an integrated sensor engine 202, an integrated equipment engine 204, and an integrated report engine 206. Junction boxes may be employed to facilitate coupling intermediate the control engine 200 and a particular element or grouping of elements. The control engine 200 manages and coordinates the interaction of the components encompassing the automation system 20. The control engine 200 is integrated because it may contain the automated controller function for all the devices within the automation system 20, and has the capacity to incorporate more operational systems.

The exemplary control engine 200 is comprised of a user interface 22, a processor 24 and memory 26. The user interface 22 may include either or both local and remote access, and may support audio, visual and manual interaction with a user. The user interface 22 may employ communication assets from the equipment engine 204 to maximize the ability to interact with a user anywhere that user may be, at any time. The processor 24 may comprise a ruggedized relatively standard computer, which means it has been adapted to be rugged enough to withstand conditions on a drilling rig 10. The processor 24 may comprise multiple computers that are integrated to be interoperable. The memory 26 includes both working memory used to actively operate the system, and non-volatile memory, which maintains the ordered contained information even if power is suspended. Memory 26 may be either or both local and remote, and may be either or both fixed in the control engine 200 and removable.

The sensor engine 202 may include devices such as sensors, meters, and detectors, which can detect activity, conditions and circumstances in an area to which the device has access. Components of the sensor engine 202 are deployed at any and all operational areas where information on the conditions in that area may be desired by an operator. Areas for deployment of components include at or near the drill bit 110, the drill string 106, the mud system assembly 112, the pipe handler assembly 114, the top drive assembly 116, and the floor wrench assembly 118, for examples, to detect physical properties that are used by systems to assess the drilling operations. Any other operational system that may be added to the automated system 20 may require unique sensor engine 202 components that may need to be place in positions essential to that particular added system. Readings from the sensor engine 202 is fed back to the control engine 200. The control engine 200 may send signals to the sensor engine 202 to adjust the calibration or operational parameters. The sensor engine 202 is integrated because it contains sensing function for all the systems within the automation system 20, and has the capacity to incorporate more operational systems.

The operational equipment engine 204 may include devices that function to facilitate the drilling operation. The equipment engine 204 may include hydraulic rams, rotary drives, valves, and pumps, just to name a few examples. The equipment engine 204 may be designed to exchange communication with control engine 200, so as to not only receive instructions, but to provide information on the operation of equipment engine 204 apart from any associated sensor engine 202. The equipment engine 204 is integrated because it contains operational equipment functions for all the systems within the automation system 20, and had the capacity to incorporate more operational systems.

The report engine 206 collects information about the drilling operation and make the information available for continual and periodic report, and for historic archival purposes, singly or in varied combination. The report engine 206 may interact with the operator through the control engine 200 to assist the operator in completing reports and collecting archival information in an accurate and timely manner. The report engine 206 is integrated because it contains reporting, documenting and archival functions for all the systems within the automation system 20, and had the capacity to incorporate more operational systems.

Centralizing the coordination of data with the integrated automation system 20 may reduce redundancy of various components of individual systems, including automated controller's and operational sensors, as well simplifying and organizing operational interfaces, while at the same time locating the automated systems in the same place from where the manual operations were coordinated. The integrated automation system 20 may be installed in a traditional rig that does not currently have automated systems. The integrated automation system 20 may also be installed in a traditional rig has an automated system. In the latter situation the current disclosure may be used to integrate the existing system with additional systems, or may replace some or all of the existing components with different components to accomplish the same systemic objectives.

Figure 3:
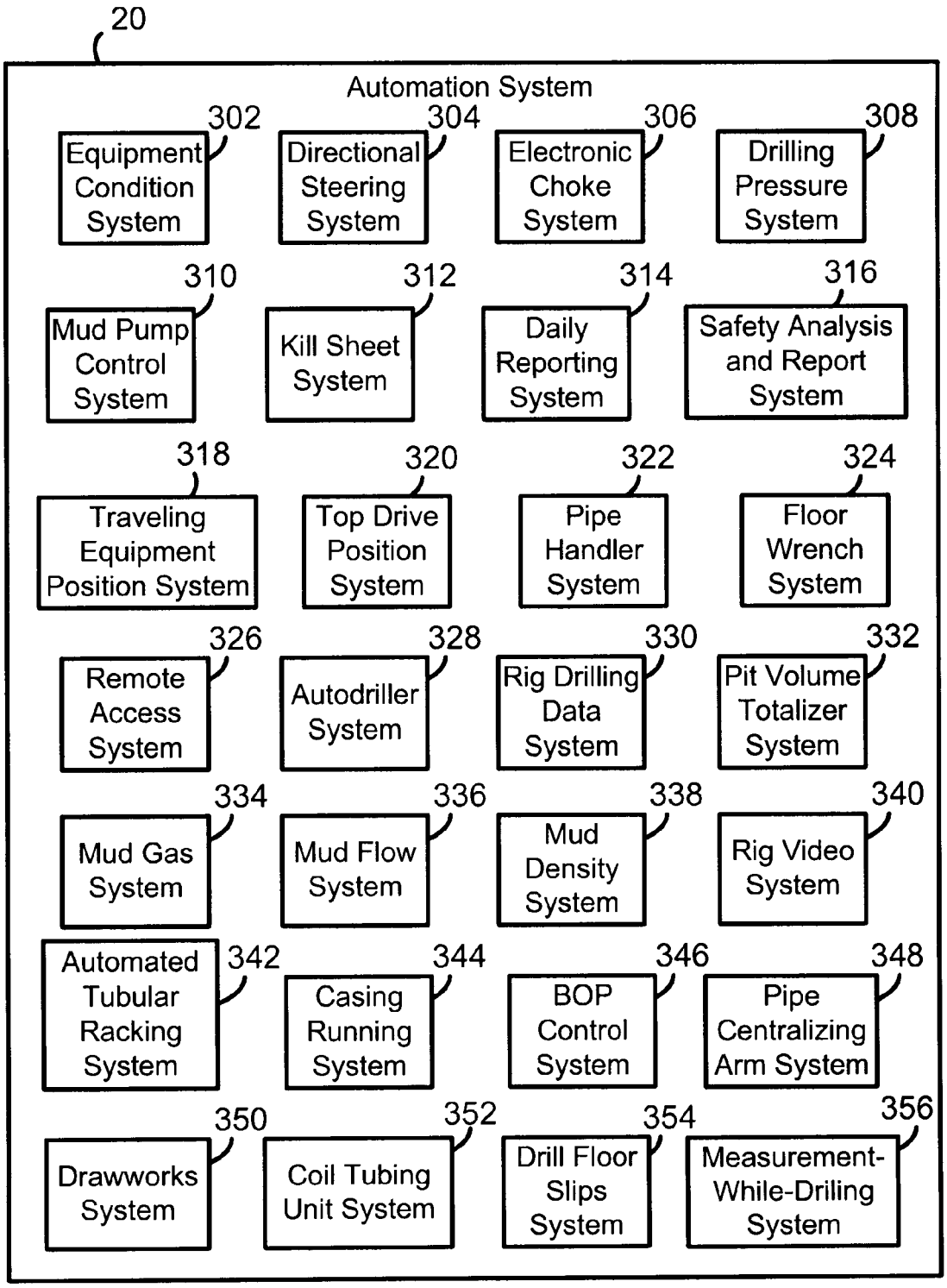
FIG. 3 is a schematic illustration of exemplary incorporable operational systems of an exemplary automated system, addable to a traditional rig.

Referring now to FIG. 3, the exemplary automation system 20 is comprised of a variety of operational, monitoring and reporting systems. A typical exemplary operational system may comprise a user interface, operational equipment, sensors, actuators, and control software, as needed for a particular system, which are incorporated in the respective engines shown in FIG. 2. In this way the operational system may be elementally embodied in two or more of the integrated control engine 200, the integrated sensor engine 202, the integrated equipment engine 204, and the integrated report engine 206. Systems may be dynamically selected to be active at any moment in an automation system 20, and when active may share the operably coupled resource components. Dynamic selection allows the automation system 20 to possess the potential to comprise a wide assortment of operating systems, while at the same time permitting convenient management of the actual operating functionality of the automation system 20. Exemplary resource components may include a common user interface 22, processor 24 and memory 26, of control engine 200, as well as the sensor engine 202, the equipment engine 204, and the report engine 206, as appropriate.

The exemplary automation system 20 includes an equipment condition system 302, a directional steering system 304, an electronic choke system 306, a drilling pressure system 308, a mud pump control system 310, a kill sheet system 312, a daily reporting system 314, a safety analysis and report system 316, a traveling equipment position system 318, a top drive position system 320, a pipe handler system 322, a floor wrench system 324, a remote access system 326, an auto-driller system 328, a rig drilling data system 330, a pit volume totalizer system 332, a mud gas system 334, a mud flow system 336, a mud density system 338, a rig video system 340, automated tubular racking system 342, a casing running system 344, a BOP ("blowout preventer") control system 346, a pipe centralizing arm system 348, a drawworks system 350, a coiled tubing unit system 352, a slips system 354, and a measurement-while-drilling ("MWD") system 356. Many of these systems are available from multiple suppliers. Though the current system provides for integrating the varied systems, it may still be more desirable to obtain as many systems as possible from the same manufacture. Nabors Industries Ltd. may provide a number of the various systems through their affiliated companies.

The exemplary equipment condition system 302 includes equipment and control modules incorporable into the automation system 20 that performs condition monitoring and alarming. Condition monitoring includes the use of advanced technologies in order to determine equipment condition, and potentially predict failure. Such advanced technologies include, but is not limited to, vibration measurement and analysis, infrared thermography, oil analysis and tribology ultrasonics, and motor current analysis. Condition monitoring is most frequently used as a predictive or condition-based maintenance technique, however, there are other predictive maintenance techniques that can also be used, including the experienced use of the human physical senses, machine performance monitoring, and statistical process control techniques. A potentially acceptable system that may be modified and incorporated into the equipment condition system 302 includes the VibeHound Kit™, available from TECHKOR™ Instrumentation. A potentially acceptable system that may be modified and incorporated into the equipment condition system 302 includes the ThermCAM™ infrared camera systems, available from FLIR Systems. A potentially acceptable system that may be modified and incorporated into the equipment condition system 302 includes the Ultraprobe® ultrasound inspection system, available from UE Systems, Inc. A potentially acceptable system that may be modified and incorporated into the equipment condition system 302 includes electrical analysis systems available from AB SKF, of Sweden. Other equipment condition systems may be seen as advantageous for incorporation into an automation system 20, given the teachings of this disclosure. Such systems may be incorporable into the automation system 20 in a similar fashion, as described in this disclosure, and achieve similar improvements in reduction in space and elimination of redundancy of component parts.

The exemplary directional steering system 304 includes components of a directional drilling system incorporable into the automation system 20 that is able to determine and control the attitude of the drill bit 110 deployed in the drill hole 108. Accurate steering control enables positioning the drill hole 108 precisely in a subterranean formation in order to better assure a highly productive well. A potentially acceptable system that may be modified and incorporated into the directional steering system 304 includes the Direction Control Steering System, available from CANRIG Drilling Technology Ltd.

The exemplary electronic choke system 306 includes components of an actuator, a control system and a communication link that may be modified and incorporated into the electronic choke system 306. The control system is integrated in the automation system 20, as may be the communication link. A potentially acceptable system that may be modified and incorporated into the electronic choke system 306 includes the Pason Electronic Choke Actuators, available from Pason Systems Corporation.

The exemplary drilling pressure system 308 includes components of a pressure control system that maintains constant bottomhole pressure ("BHP") while drilling. Drilling operations in challenging environments can benefit from being able to overcome the pressure limitations of conventional drilling and expand prospective drillable areas. Constant bottomhole pressure is achieved through rapid, dynamic and consistent backpressure control without interruption, with or without rig pumps. A potentially acceptable system that may be modified and incorporated into the drilling pressure system 308 includes the Dynamic Annular Pressure Control ("DAPC") System, available from At Balance Americas L.L.C. The DAPC System can achieve constant BHP using a control system integrated with real-time hydraulics modeling, and an auxiliary pump to provide backpressure when the rig pumps are off.

The exemplary mud pump control system 310 includes components of a mud supply and circulation system that may be modified and incorporated into the mud pump control system 310. Mud pumps are typically large, high-pressure reciprocating pumps used to circulate the mud on a drilling rig 10. A typical mud pump is a two or three-cylinder piston pump with replaceable pistons that travel in replaceable liners, and are driven by a crankshaft actuated by an engine or a motor. Mud pumps keep the critical supply of mud moving to the bottom of the drill string 106 and back up the drill hole 108 to the surface for reclamation. The flow of mud must be maintained at an appropriate level as dictated by the situation being experienced. A control system switches the pumps on and off, and adjusts the pumps speed of operations, in order to adjust the rate of mud flow. A potentially acceptable system that may be modified and incorporated into the mud pump control system 310 includes an electric motor control system provided by National Oilwell Varco, of Houston, Tex.

The exemplary kill sheet system 312 includes components for completing well calculations. A kill sheet system will help drilling and workover personnel calculate data to successfully control the well. The system allows personnel to enter well data at the job site and then make calculations necessary to complete planning the tasks. A system should help eliminate mathematical errors while providing simple and consistent well calculation methods. A potentially acceptable system that may be modified and incorporated into the kill sheet system 312 includes the Kill Sheet Program, available from the Well Control School, of Houston, Tex.

The exemplary daily reporting system 314 includes components of systems that assist in the preparation of the various periodic reports required during drilling operations. A system may mimic a traditional tour sheet, plus may provide additional functionality, including payroll processing, safety and incident reporting, and sophisticated database analysis, including time-breakdown, pie-charts, and days versus depth plots. A potentially acceptable system that may be modified and incorporated into the daily reporting system 314 includes RIGREPORT™, an electronic tour sheet database system available from Epoch Well Services, Inc.

The exemplary safety analysis and report system 316 includes components of a rig electronic job safety analysis and incident reporting system that may be modified and incorporated into the safety analysis and report system 316. A safety analysis and report system may be a computerized application that the driller and rig crew use to preview and review work activities, and to report any near miss or injurious incidents on a day to day basis. A potentially acceptable system that may be modified and incorporated into the safety analysis and report system 316 includes RiskSafe™ 7, a qualitative workplace risk assessment software package, provided by Dyadem International Ltd., of Richmond Hill, Ontario, Canada. An additional potentially acceptable system that may be modified and incorporated into the safety analysis and report system 316 includes AIRSWEB™ reporting software system, by Safety Management Systems, Inc., of New York City, N.Y.

The exemplary traveling equipment position system 318 includes components of systems that monitor, anticipate, alert and avoid potential equipment collisions. Anti-collision systems include points along a line of travel where the system notes the potential for danger and either or both sounds an alarm and interrupts that movement. A potentially acceptable system that may be modified and incorporated into the traveling equipment position system 318 include the Traveling Equipment Anti-Collision System, available from Canrig Drilling Technology Ltd., and the Anti Collision System, available from Bentec GmbH Drilling & Oilfield Systems, of Germany.

The exemplary top drive position system 320 includes components of an alert system that warns the driller that the elevator links are in the over drill position and at risk of contacting the racking board if hoisting of the top drive continues. Key components are designed to ensure immediate and precise feedback to the driller that may, for example, be in the form of either or both an audible and visual alarm. Through the automation system 20, the top drive position system 320 may employ components of the traveling equipment position system 318 in order to avoid redundancy. A potentially acceptable system that may be modified and incorporated into the top drive position system 320 includes the Top Drive Elevator Position Alarm System, available from Canrig Drilling Technology Ltd.

The exemplary pipe handler system 322 includes components of tubular handling systems that may be modified and incorporated into the pipe handler system 322. Pipe handlers move tubulars, such as drill collars, drill pipe, casing, subs, logging tools and other tubulars, from a storage rack to the drill floor. Remote control systems permit system operation that almost eliminates human contact with the items being moved. Through the automation system 20, the pipe handler system 322 may employ components of the traveling equipment position system 318 in order to avoid redundancy. A potentially acceptable system that may be modified and incorporated into the pipe handler system 322 includes The PowerCAT™ Automated Catwalk, available from Canrig Drilling Technology Ltd.

The exemplary floor wrench system 324 includes components of an automated floor wrench system that operates to connect segments of drill pipe into a drill string 106. As with other engines, through the automation system 20, the floor wrench system 324 may share components of automation system 20 used by other engines in order to avoid redundancy. A potentially acceptable system that may be modified and incorporated into the floor wrench system 324 includes the Torq-Matic™ Fully Automated Floor Wrenches, available from Canrig Drilling Technology Ltd. The exemplary remote access system 326 includes components of communication systems that enable remote access and control of automated electronic and computerized systems. Some systems that may be suitable include connection to a local area network, an intranet, the internet or World Wide Web, email, and wireless broadband technologies, such as satellite, microwave, cellular, PCS, GSM, and others. For portions of the remote access system that may span shorter distances technologies such as infrared, Bluetooth®, and Wi-Fi® may be appropriate. A remote access system may permit modification, troubleshooting and updating of the automation system 20, and its incorporated engines, from a remote location. A remote access system may also enable multi-directional transmission of reports and archival data. A potentially acceptable system that may be modified, in light of the present disclosure, and incorporated into the remote access system 326 includes communication equipment available through either or both Siemens AG and Rockwell Automation, of Milwaukee, Wis.

The exemplary autodriller engine 228 includes components of an autodriller system designed to monitor and adjust the weight on bit and differential pressure with acute precision in order to maximize the rate of penetration ("ROP") of the drill bit 110. In an exemplary system the autodriller precisely actuates the drilling rig's 10 drawworks brake handle using continuous feedback from hook load, differential pressure and drawworks drum rotation. Absolute digital settings for either or both weight on bit ("WOB") and differential pressure parameters may be entered into the system, which then permits adding weight to the bit until either or both the desired WOB and differential pressure is reached. A potentially acceptable system that may be modified and incorporated into the autodriller engine 228 includes the Pason Electronic AutoDriller, available from Pason Systems Corporation.

The exemplary rig drilling data system 330 includes components of a computerized local area network system that may have input and output stations throughout a drilling rig 10 to provide essential data needed at a particular location for the role of the people at that location. Drilling data may be viewed at the work station on the floor, in the doghouse, and by the company man and toolpusher. Each person may be able to pull up the information at any of these workstations, and necessary data can be logged and stored on site. A system may also permit secure remote access to the network, along with data transfer to locations worldwide, through the remote access system 326. Potentially acceptable systems that may be modified and incorporated into the rig drilling data system 330 include RIGCHART™, FLOWSHOW™, and RIGWATCH™, and may be supplemented with reporting tools, such as PERC™ and RIGREPORT™, each available from Epoch Well Services, Inc. An additionally potentially acceptable system that may be modified and incorporated into the rig drilling data system 330 includes the Pason EDR, for electronic drilling recorder, available from Pason Systems Corporation.

The exemplary pit volume totalizer system 332 includes components of an integrated system for the management of mud volumes throughout the mud system. Such systems take into consideration intermittent power and the potential for a critical situation to arise quickly, and manage the positioning of mud to be able to address unfavorable situations. A potentially acceptable system that may be modified and incorporated into the pit volume totalizer system 332 includes the Pason Pit-Bull™ Pit Volume Totalizer & Flow Show, available from Pason Systems Corporation.

The exemplary mud gas system 334 includes components of a system to detect changes in relative volumes of hydrocarbon gases at the surface without complex offline analysis, delicate instrumentation, or expensive gas chromatographs. The system may send data via remote access system 326 to relevant observers wherever they may be located. Alarms can be set to notify the geologist if the gas level in the mud reaches or falls below a desired percent setting. A potentially acceptable system that may be modified and incorporated into the mud gas system 334 includes the Pason Total Gas System, available from Pason Systems Corporation.

The exemplary mud flow system 336 includes components of a system to monitor mud flow rate and velocity sensor, which has proven to be effective for early gas kick detection through recognizing changes in the flow rate. Early detection permits rig personnel extra time to mitigate an upcoming gas bubble. A potentially acceptable system that may be modified and incorporated into the mud flow system 336 includes the Rolling Float Meter, available from Epoch Well Services, Inc.

The exemplary mud density system 338 includes components of a system to monitor and maintain the density of the drilling mud. Automated sensors and the digital electronics are immersed in the mud pit in order to maintain continual monitoring. A potentially acceptable system that may be modified and incorporated into the mud density system 338 includes the Mud Density Sensor, available from Epoch Well Services, Inc.

The exemplary rig video system 340 includes components of a camera, recorder and surveillance system that typically operate within a controlled area network. Within the automation system 20, the video system may provide real-time visual monitoring and inspection of operational areas that can be done from the doghouse, or anywhere in the world. A potentially acceptable system that may be modified and incorporated into the rig video system 340 includes the HERNIS CCTV Systems, available from Hernis Scan Systems AS, of Norway.

The exemplary automated tubular racking system 342 includes components of a system to move the drilling pipe sections between a storage rack and an operational position. A potentially acceptable system that may be modified and incorporated into the automated tubular racking system 342 includes the Iron Derrickman™ racking board mounted pipe handling system, available from Iron Derrickman Ltd., of Calgary, Alberta, Canada.

The exemplary casing running system 344 includes components of a system to supply makeup, torsional and axial loads from the top drive to the drilling string. The drilling string may be comprised of a conventional drilling string or the casing. A potentially acceptable system that may be modified and incorporated into the casing running system 344 includes the Casing Drive System™, by Tesco Corporation, of Calgary, Alberta, Canada.

The exemplary BOP control system 346 includes components of a blowout preventer system at the top of a well permits the drill hole 108 to be closed if the drilling crew loses control of formation fluids. By closing the BOP, the drilling crew may regain control of the reservoir, typically by increasing the mud density until it is possible to open the BOP and retain pressure control of the formation. A potentially acceptable system that may be modified and incorporated into the BOP control system 346 includes the U-BOP™ blowout preventer, by Cameron International Corporation, of Houston, Tex.

The exemplary pipe centralizing arm system 348 includes components of a system to guide the operation of drill pipe and drill collars being handled by hoisting equipment. A pipe centralizing arm system is typically mounted on the derrick 102. A potentially acceptable system that may be modified and incorporated into the pipe centralizing arm system 348 includes the Stabber Arm™ stabilizer arm and control system available from National Oilwell Varco. An additional potentially acceptable system that may be modified and incorporated into the pipe centralizing arm system 348 includes the ODS™ stabilizer arm and control system available from ODS International Inc., Houston, Tex.

The exemplary drawworks system 350 includes components of a system to reel out and reel in the drilling line in a controlled fashion, thereby causing items hung in a well to be lowered into or raised out of the drill hole 108. A typical drawworks consists of a large-diameter steel spool, brakes, a power source and assorted auxiliary devices. A potentially acceptable system that may be modified and incorporated into the drawworks system 350 includes the IDM MAC™ modular AC drawworks, by IDM Equipment Ltd., Houston, Tex.

The exemplary coiled tubing unit system 352 includes components of a system to control, feed and withdraw coiled tubing string within a drill hole 108. A potentially acceptable system that may be modified and incorporated into the coiled tubing unit system 352 includes the Coiled Tubing Injector Head by PSL Energy Services, of Portlethen, Aberdeen, United Kingdom.

The exemplary slips system 354 includes components of a system to engage the drill string in order to perform pipe handling operations. A potentially acceptable system that may be modified and incorporated into the slips system 354 includes the PS 500 Power Slip drill floor slip, by Blohm+Voss Repair GmbH, of Hamburg, Germany.

The exemplary MWD system 356 includes components of a system to evaluate the physical properties, usually including pressure, temperature and wellbore trajectory in three-dimensional space, while extending a wellbore. Measurements are typically made downhole, stored in solid-state memory for some time and later transmitted to the surface. A potentially acceptable system that may be modified and incorporated into the MWD system 356 includes the Ryan's Measurement While Drilling (MWD) system, by Ryan Energy Technologies USA, Inc., Houston, Tex.

An assortment of operating systems, either or both including or similar to those described above may be included in the automation system 20. An administrator of the automation system 20 may dynamically activate a chosen operating system. Activation provides the operator with access to the functionality of the activated operating system. Similarly, an administrator of the automation system 20 may dynamically deactivate a chosen operating system, denying the operator the functionality of the deactivated operating system. The dynamic activation and deactivation may occur either or both locally to the automation system 20, and remotely, and may be executed by any individual or combination of techniques, including manual, electronic, automated and computerized.

Figure 4A:
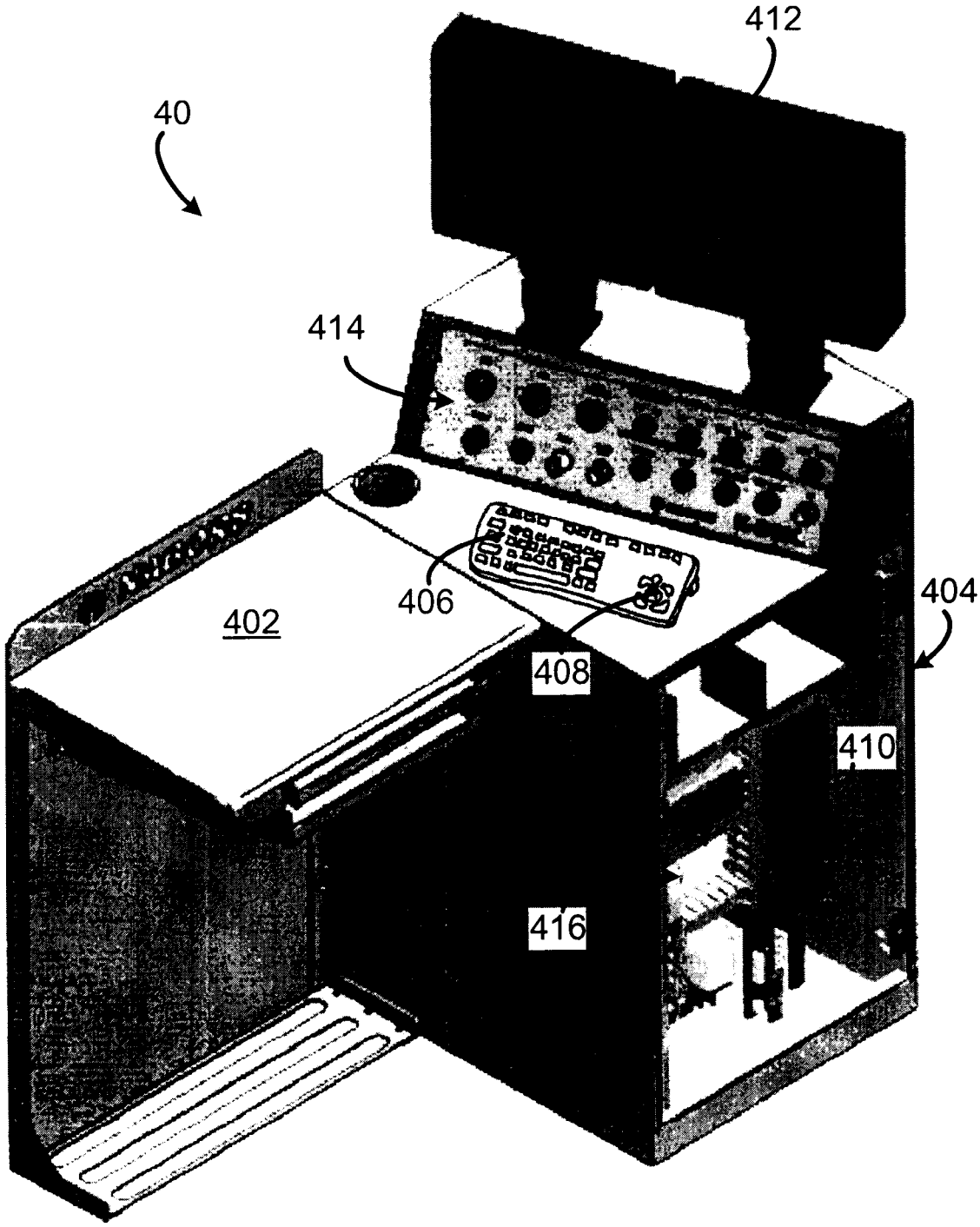
FIG. 4A is a schematic view of an exemplary K-Box device.

Referring to FIG. 4A, the control engine 200 may be embodied in the exemplary K-Box device 40. The exemplary K-Box device 40 is comprised of a hinged work surface 402, a cabinet 404, a keyboard 406, a pointing device 408, a personal computer 410, video displays 412, manual equipment engine controls 414, and operational systems control circuitry 416. The hinged work surface 402 provides a familiar area for the driller to review reports and maintain small desired items. The hinged work surface 402 provides a surface upon which documents, references and other items may be laid. The hinged work surface 402 may be raised to access an interior space within cabinet 404 that is separate from a space that may house equipment for the automation system 20. Miscellaneous items useful to the operator may be stored in the interior space below the hinged work surface 402. The cabinet 404 provides protection and organization for the computer 410 and operational systems control circuitry 416.

The keyboard 406 provides data entry capability to the overall user interface 22 (shown in FIG. 2). The K-Box device 40 may be designed with a virtual keyboard displayed on a touch screen. The pointing device 408 permits manipulation of either or both the cursor on the video displays 412, and the physical maneuvering of equipment, such as the pipe handler assembly 114. Various pointing devices may be suitable, including, but not limited to a joystick, a trackball, a touchpad, and a mouse. Collectively, the keyboard 408 and suitable pointing device 406 may be referred to as control engine interaction devices, since they interact with the control engine 20 to facilitate desired function of automation system 200 (shown in FIG. 2).

The video displays 412 may display an assortment of information and data, including an operational software interface for each of the automation system's 20 operational, monitoring and reporting systems 302-356, examples of which are shown in FIG. 3. The operational software interface for each of the operational systems 302-356 may include a combination of information from various operational systems 302-356 on a single video display 412 screen. The software interface may display operational readings and reports, as well as images from cameras located around the rig on the video displays 412. Additional video displays 412, keyboards 408 and pointing devices 406 may be remotely located from the cabinet 404, and positioned at various locations around the rig 10 to meet user interface requirement in those locations where the users physically operate and observe the function of the rig 10. Remote computer systems, with an independent computer processor may also access the information and data of the automation system 20. Such a remote computer system may be removed from the doghouse 104 to other desired locations, including being removed to locations remote to the rig 10.

The manual equipment engine controls 414 may be considered operational systems controls, since they permit the user of the automation system 200 to affirmatively affect the operation of particular pieces of the equipment engine 204 (shown in FIG. 2). The exemplary manual equipment engine controls 414 include a power button, a stop button, a start button, an emergency stop button, an alarm indicator, autodriller controls for ROP, WOB and delta pressure, an on/off switch for the audible alarm, an on/off switch for the directional steering control system, a crown/floor saver on light, a mud pump stop button, choke opening and closing switches, and buttons to modify the image on the video displays 412. Additional manual equipment engine controls 414, may be remotely located from the cabinet 404, and positioned at various locations around the rig 10 to meet a user interface requirement in a specific location.

The operational system control circuitry 416 may include specialized circuits essential to the operation of a particular operational engine. The circuitry is integrated into the control engine 200 to share user interface 22, the computer 410 and the displays 412, as well as any operational elements that would be duplicated in stand-alone operational systems. In an exemplary embodiment, the integration of operational systems may be accomplished through a number of various bus and interfaces configurations, including OLE for Process Control (OPC), MODBUS, Transmission Control Protocol (TCP), WITS telemetry protocol, DF-1 protocol, PROFIBUS, also known as Process Field Bus, serial bus, universal serial bus, Ethernet, 802-11x standards, and current loops, including 4-20 mA, to name a few examples.

In an exemplary embodiment, the operational system control circuitry 416 facilitates the communication of control engine 200 with the integrated sensor engine 202, the integrated equipment engine 204, and the integrated report engine 206 through electrical wiring, either wired directly or through any of a variety of bus configurations. The electronic signals may activate horn, lights for alarms, the recording of information in memory to act as a chart recorder. The electronic signals may travel through the user interface 22 to other computer systems, where additional processing and archival operations may occur. In an exemplary embodiment, the control engine 200 sends controlling outputs from its processor 24 to external devices and equipment for control purposes via electronic signals that may operate within the configurations of 4-20 mA, 0-24 V DC and 0-10 V DC.

The K-Box device 40 may serve as a platform to add new technologies to a rig 10 without having to design a new enclosure. Technologies such as joystick controls, crown floor savers, autodrillers, video monitors, and etcetera, can be added to the console without major modifications. Through the K-Box device 40, the new technology becomes integral to the rig 10. The K-Box device 40 can easily be repackaged to adapt to changes in the doghouse 104, such as the addition of a chair or complete driller's console. In an alternate embodiment, various components, such as the work surface 402, may be eliminated.

Figure 4B:
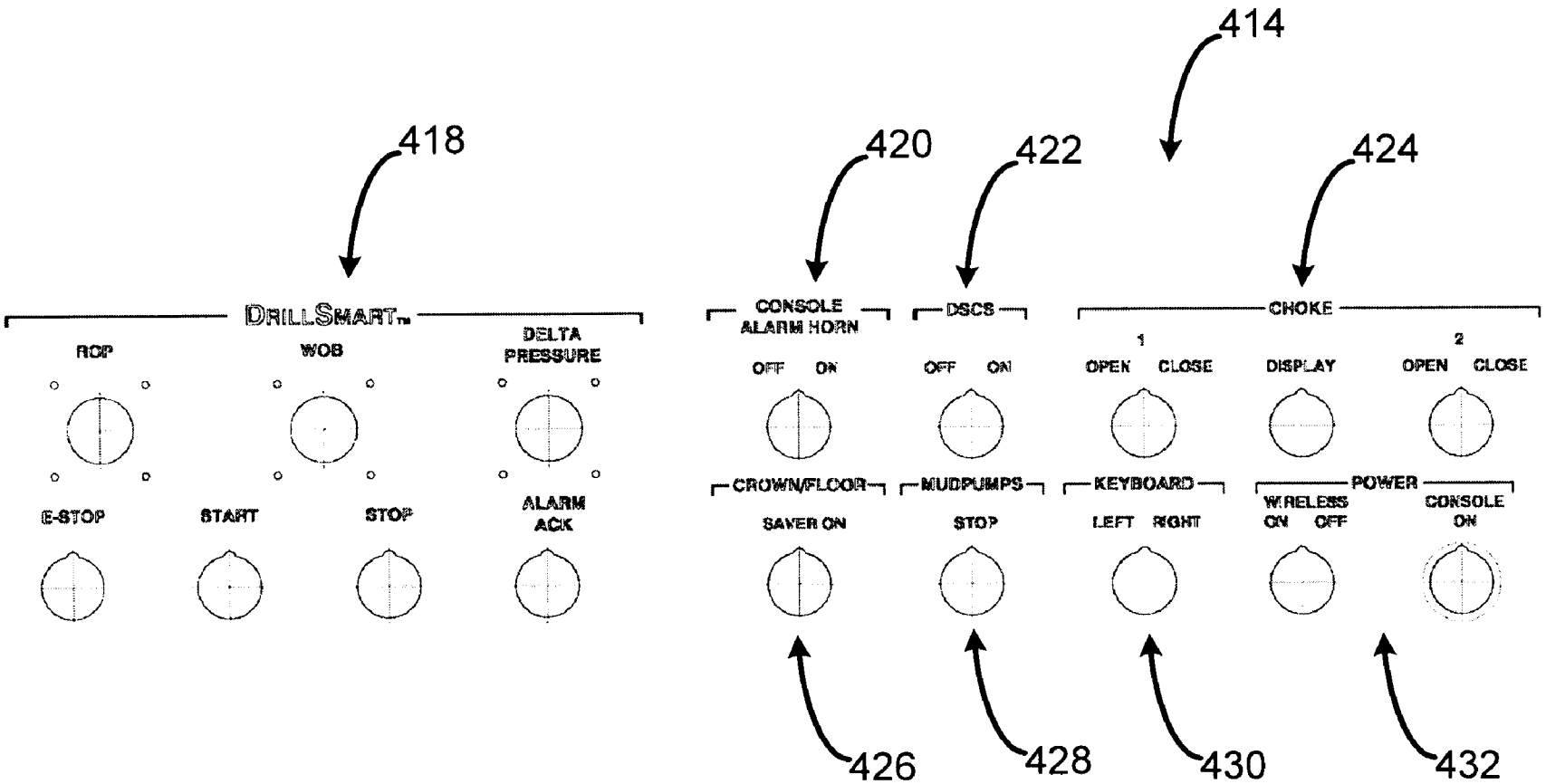
FIG. 4B is a diagram of the manual equipment engine controls of FIG. 4A.

Referring to FIG. 4B, the exemplary set of manual equipment engine controls 414 includes autodriller controls 418 for an autodriller system 328, a console alarm control 420, a directional steering control system control 422 for a directional steering system 304, choke controls 424 for an electronic choke system 306, a crown/floor saver control 426, a mudpump control 428 for a mud pump control system 310, a keyboard control 430, and power controls 432.

In the exemplary embodiment, autodriller controls 418 include a ROP control knob, a WOB control knob, delta pressure control knob, an E-Stop button, a start button, a stop button, and an alarm ack button. The ROP control knob, which is similar to a potentiometer, allows for setting of the ROP set point or target, and the ROP limit or shutdown. The WOB control knob, which is similar to a potentiometer, allows for setting of the WOB set point or target, and the WOB limit or shutdown. A delta pressure control knob, which is similar to a potentiometer, allows for setting of a differential pressure set point or target, a differential pressure limit or shutdown, and a mud pump high pressure alarm point. An E-Stop or emergency stop mushroom maintained pushbutton to stop automatic driller. A start illuminated momentary pushbutton to start automatic driller and provide indication when running. A stop momentary pushbutton to stop the automatic driller. An Alarm Ack or alarm acknowledgement illuminated momentary pushbutton to provide visual indication of autodriller alarms, and a method for acknowledgement and horn silencing.

In the exemplary embodiment, console alarm control 420 includes an Off/On maintained two-position indicator that illuminates when an alarm is present and allows the DAQ alarm horn to be turned off. In the exemplary embodiment, directional steering control system control 422 includes an Off/On maintained two-position selector switch that turns the directional steering control system off and on.

In the exemplary embodiment, choke controls 424 include two Open/Close spring return-to-center three-position selectors used to open and close chokes 1 and 2, respectively, and a display momentary pushbutton used to immediately select the choke display on video display 412. In the exemplary embodiment, crown/floor saver control 426 include a Saver On indicator that provides visual indication that the crown/floor saver is active. In the exemplary embodiment, mudpump control 428 includes a Stop mushroom maintained pushbutton to stop the mud pumps. In the exemplary embodiment, keyboard control 430 includes a Left/Right maintained two-position switch that allows one keyboard to be used with two displays as video display 412.

In the exemplary embodiment, power controls 432 include a Wireless On\Off maintained two-position key switch that interrupts power to the wireless, which is typically used when perforating or completing a well, and a Console On illuminated momentary pushbutton, which performs the operations of a steady-on light to indicate UPS and conditioned power normal, a blinking light to indicate the K-Box device 40 is on UPS power, and a test lamp function when the pushbutton is depressed.

Figure 5:
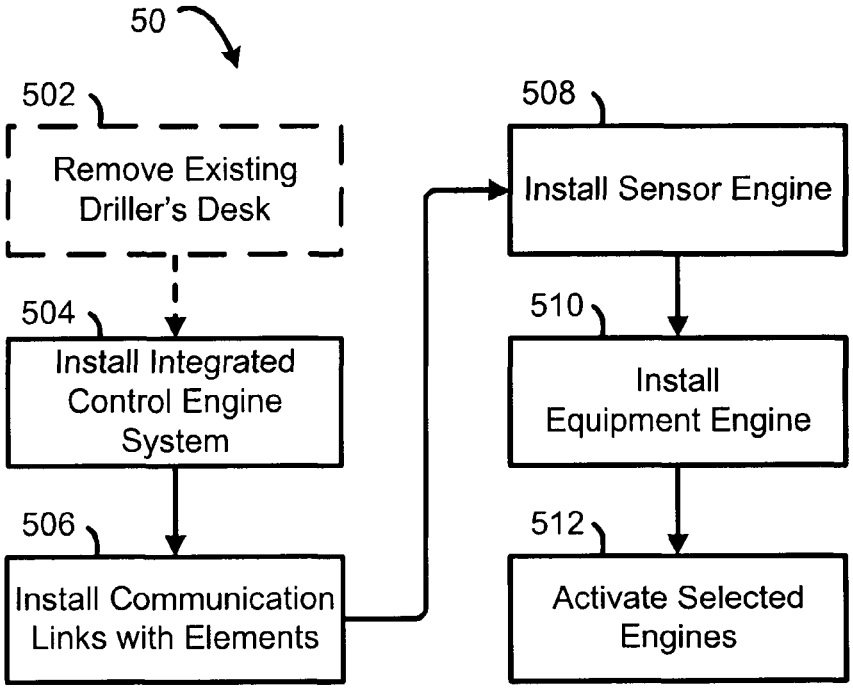
FIG. 5 is a flow chart illustration of an exemplary embodiment of the method of augmenting a traditional rig with an automated system.

Referring to FIG. 5, an exemplary method 50 for incorporating automated systems into a drilling rig 10 comprises removing an existing driller's desk, if such a desk exists, at 502, installing an integrated control engine system at 504, installing communication link capacity for the components of the automation system at 506, installing a sensor engine at 508, installing an equipment engine at 510, and dynamically activating selected engines at 512. The optional preliminary step of removing an existing driller's desk at 502, depicted with dotted lines, may be necessary before installing the integrated control engine system at 504. The control engine 200 is an example of an integrated control engine system that can be installed at 504. The exemplary control engine 200 may be designed to fit into the same space as the traditional knowledge box, such as in the form of a K-Box device 40. The traditional knowledge box can be cut from the doghouse 104 and the control engine 200, which may be in the form of the K-box device 40, may be welded in its place in a short period of time.

The K-box device 40 has a desktop 402 to complete manual reports, and also has a computerized interface devices, such as keyboard 406, pointing device 408, and video displays 412 located to control and monitor all activities, as part of the automated system's 20 user interface 22. By reducing the number of independent system interfaces, which may be combined into the control engine 200, sufficient space is recovered to permit the use of standard computers and monitors ruggedized for the intended environment.

The communication links installed at 506 permits the coupled elements and engines to transfer and exchange data, and may include conventional wiring, and may incorporate wireless communication methods, such as infrared, Wi-Fi® and BlueTooth®, which are provided merely as examples. The link capacity established at 506 may connect the control engine 200 with any element of the sensor engine 202, the operational equipment engine 204, and the report engine 206. Additionally, the link capacity established at 506 may be installed in anticipation of future elements, so that, for example, a particular sensor may not be available, but the communication is put in place in anticipation of the sensor.

The sensors and equipment controls installed at 508 include the various sensors and meters to provide necessary input to the control engine 200, as well as hydraulic rams, valves, pumps and other pieces of equipment that are operable by the automated systems 20.

At 510, the functionality of a particular engine is activated within the control engine 200. In this fashion, a unitary control engine 200 can be produced by a supplier, comprising a full set of operational engines, and the functionality either needed or wanted by a user can be customized as necessary, making only those engines purchased by the user operational. The activation, or deactivation, of selected engines at 510 may occur at any time during the operation of the automation system 20, as controlled by a system administrator. With the availability of remote communication with control engine 200, the system administrator could be located anywhere in the world while modifying the functionality of the automation system 20.

Figure 6:
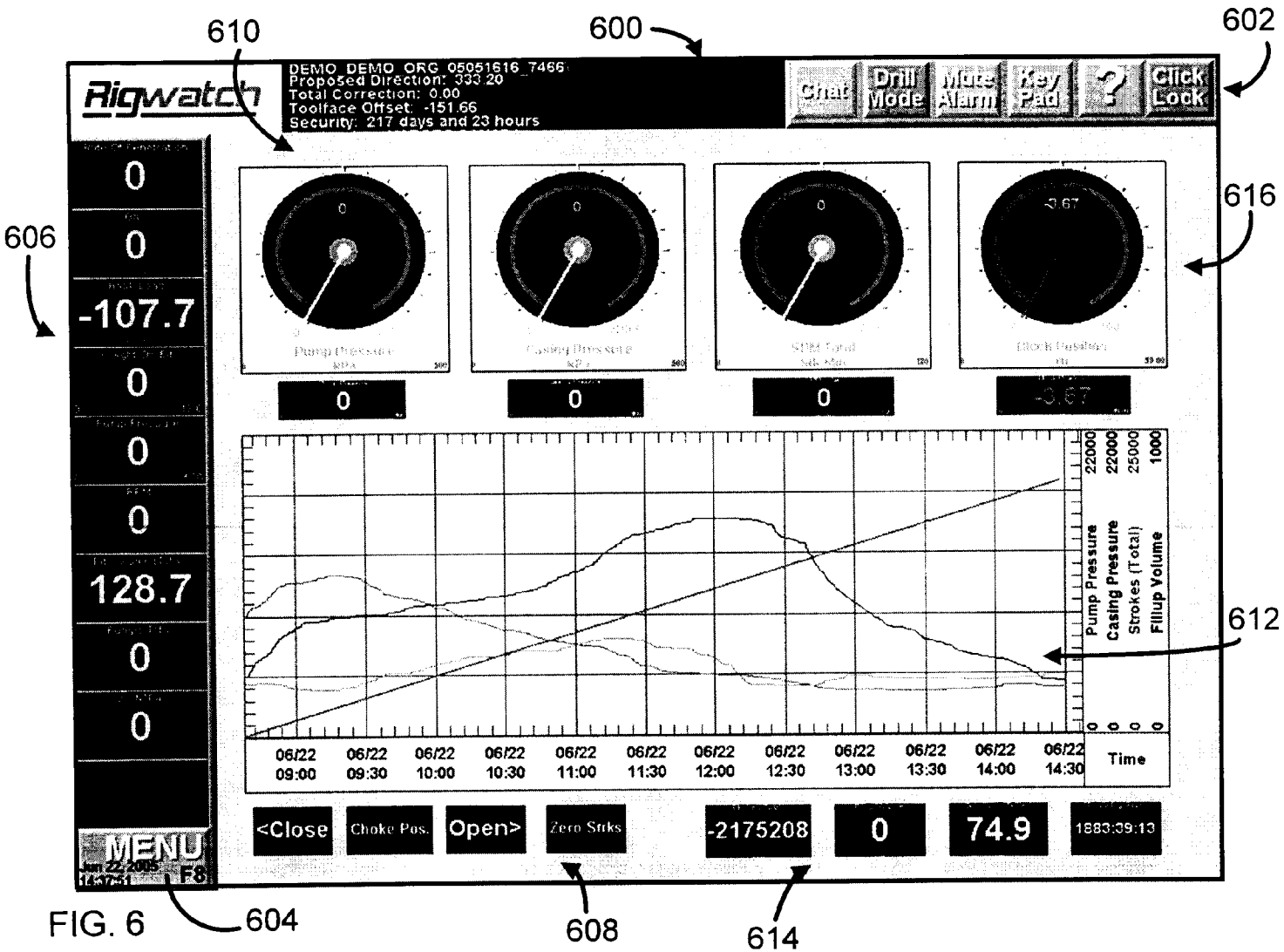
FIG. 6 is an exemplary display screen according to the current disclosure.

Referring now to FIG. 6, an exemplary embodiment may have a user interface 22 that includes a display screen 600 where any combination of information, GUI's, and touch controls, among other items, from one or more of the various operational systems 302-356, may be shown. In the exemplary embodiment, the display screen 600 has a screen toolbar 602, a menu control element 604, a system display area 606 for a Rig Drilling Data System 330, a system display area 608 for an electronic choke system 306, a paired analog and digital displays area 610 for information on a drilling pressure system 308, a historical data display area 612 for information on a drilling pressure system 308, and a digital display area 614 for other desired information on a drilling pressure system 308.

In the exemplary embodiment, the toolbar 602 includes a button to create a "chat" or discussion group regarding information coming from the system 20, a button that initiates modification of the display screen 600 and drill mode of the system 20, a button to mute alarms, a button to open a pop-up keypad, a button to initiate help and a button to lock the click operation of display screen 600.

In the exemplary embodiment, the display area 606 includes information regarding drilling operations and the rig drilling system 330, including the ROP, gas units, hook load, WOB, pump pressure, RPM's, total pit volume, and total pump operation time. A rig drilling data system 330 may obtain information to display in display are 606 from a variety of sources, including a hookload sensor, a pump pressure sensor, a pump stroke sensor, a casing pressure sensor, a return flow sensor, a block position or ROP sensor, a pit levels sensor, a bit torque sensor, a bit RPM sensor, a top drive elevator position sensor, a MWD sensor, and an alarm system. The sensors within rig drilling system 330 may provide analog or digital signals to the automation system 200, wherein the processor 24 uses the information to render a representative image of what the data means through the user interface 22, which in this example is the display screen 600. The connection between the sensors and the automation system 200 may be made with dedicated connections or may be connected through any of a variety of shared bus configurations. An exemplary embodiment may display other information than that shown, pertaining to the rig drilling system 330.

In the exemplary embodiment, the system display area 608 includes information regarding the electronic choke system 306, and includes operational buttons to open or close the choke, as well as a button to render information regarding choke position on the video display 412. A choke control system 306 may obtain information to display in display area 608 from a variety of sources, including a pump pressure sensor, a pump stroke sensor, a casing pressure sensor, a return flow sensor, a pit levels sensor, and an alarm system. The sensors within electronic choke system 306 may provide analog or digital signals to the automation system 200, wherein the processor 24 uses the information to render a representative image of what the data means through the user interface 22, which in this example is the display screen 600. The connection between the sensors and the automation system 200 may be made with dedicated connections or may be connected through any of a variety of shared bus configurations. An exemplary embodiment may display other information obtainable than that shown pertaining to the electronic choke system 306.

In the exemplary embodiment, the paired analog and digital displays area 610 includes information regarding the drilling pressure system 308, and includes the pump pressure, the casing pressure, the strokes per minute total, and the block position. A managed pressure drilling system 308 may obtain information to display in display area 610 from a variety of sources, including a hookload sensor, a pump pressure sensor, a pump stroke sensor, a casing pressure sensor, a return flow sensor, a block position or ROP sensor, and an alarm system. The sensors within drilling pressure system 308 may provide analog or digital signals to the automation system 200, wherein the processor 24 uses the information to render a representative image of what the data means through the user interface 22, which in this example is the display screen 600. The connection between the sensors and the automation system 200 may be made with dedicated connections or may be connected through any of a variety of shared bus configurations. An exemplary embodiment may display other information than that shown pertaining to the drilling pressure system 308.

In the exemplary embodiment, the historical data display area 612 includes additional information regarding the drilling pressure system 308, and includes a historical graph that is developed in realtime of the pump pressure, the casing pressure, the strokes per minute total, and the fullup volume. The sensors within drilling pressure system 308 may provide analog or digital signals to the automation system 200, wherein the processor 24 uses the information to render a representative image of what the data means through the user interface 22, which in this example is the display screen 600. An exemplary embodiment may display other historical information pertaining to the drilling pressure system 308 that the processor 24 can render from the information obtained by various sensors.

In an exemplary embodiment, the system display area 614 includes information regarding the drilling operations and the rig drilling data system 330, including total strokes, fill up volume, gain/loss and circulating hours. An exemplary embodiment may display other information pertaining to the rig drilling data system 330.

In the exemplary embodiment, the paired analog and digital displays area 616 includes information regarding the drilling operations and the rig drilling data system 330, including the block position. An exemplary embodiment may include paired analog and digital displays of other information pertaining to the rig drilling data system 330.

The present device permits a substantial reduction in redundancy created by the prior approach of installing individual, disparate systems. A prior art auto driller system 328 may have a hookload sensor, a pump pressure sensor, a pump stroke sensor, a casing pressure sensor, a block position or ROP sensor, a bit torque sensor, a bit RPM sensor, a top drive elevator position sensor, a MWD sensor, an alarm system, a visual display, and a set of operational controls. A prior rig drilling data system 330 may have a hookload sensor, a pump pressure sensor, a pump stroke sensor, a casing pressure sensor, a return flow sensor, a block position or ROP sensor, a pit levels sensor, a bit torque sensor, a bit RPM sensor, a top drive elevator position sensor, a MWD sensor, an alarm system, and four visual displays. A prior mud logging system may have a hookload sensor, a pump pressure sensor, a pump stroke sensor, a casing pressure sensor, a return flow sensor, a block position or ROP sensor, a pit levels sensor, a MWD sensor, an alarm system, and two visual displays. A prior MWD system 356 may have a pump pressure sensor, a return flow sensor, a block position or ROP sensor, a MWD sensor, an alarm system, and two visual displays. A prior directional drilling system may have a hookload sensor, a pump pressure sensor, a pump stroke sensor, a casing pressure sensor, a return flow sensor, a block position or ROP sensor, a bit torque sensor, a bit RPM sensor, a MWD sensor, an alarm system, and a visual display. A prior directional steering control system 304 may have a bit torque sensor, a bit RPM sensor, a MWD sensor, an alarm system, a visual display, and a set of operational controls. A prior top drive position system 320 may have a block position or ROP sensor, a bit torque sensor, a bit RPM sensor, a top drive elevator position sensor, an alarm system, a visual display, and a set of operational controls. A prior equipment condition monitoring ("ECM") system 302 may have a hookload sensor, a pump pressure sensor, a pump stroke sensor, a casing pressure sensor, a return flow sensor, a block position or ROP sensor, a pit levels sensor, a bit torque sensor, a bit RPM sensor, a top drive elevator position sensor, a MWD sensor, an alarm system, and a visual display. A prior mud pump synchronizer ("MP Sync") may have pump stroke sensor, an alarm system, a visual display, and a set of operational controls. A prior soft torque system may have a hookload sensor, a bit torque sensor, a bit RPM sensor, an alarm system, a visual display, and a set of operational controls. A prior crown floor saver system may have a block position or ROP sensor, a top drive elevator position sensor, an alarm system, a visual display, and a set of operational controls. A prior choke control system 306 may have a pump pressure sensor, a pump stroke sensor, a casing pressure sensor, a return flow sensor, a pit levels sensor, an alarm system, a visual display, and a set of operational controls. A prior managed pressure drilling system 308 may have a hookload sensor, a pump pressure sensor, a pump stroke sensor, a casing pressure sensor, a return flow sensor, a block position or ROP sensor, an alarm system, two visual displays, and a set of operational controls. If all of these systems were to be combined in a single automation system 20, according to the current disclosure, the exemplary automation system 20 could result in a reduction of five hookload sensors, six pump pressure sensors, seven pump stroke sensors, five casing pressure sensors, five return flow sensors, seven block position or ROP sensors, three pit levels sensors, six bit torque sensors, six bit RPM sensors, four top drive elevator position sensors, six MWD sensors, twelve alarm systems, seventeen visual displays, and seven sets of operational controls.

Although only a few exemplary embodiments have been described in detail above, those skilled in the art will readily appreciate that many modifications are possible in the exemplary embodiments without materially departing from the novel teachings and advantages of this disclosure. Accordingly, all such adjustments and alternatives are intended to be included within the scope of the invention, as defined exclusively in the following claims. Those skilled in the art should also realize that such modifications and equivalent constructions or methods do not depart from the spirit and scope of the present disclosure, and that they may make various changes, substitutions, and alternations herein without departing from the spirit and scope of the present disclosure.

What is claimed is:

1. A system for augmenting a traditional rig with automated operating functionality, comprising:

a plurality of automation system components comprising an integrated control engine operably coupled with, and adapted to send to and receive information from each of an integrated sensor engine, an integrated equipment engine, and an integrated report engine; and a plurality of individual operational systems elementally embodied in at least two of the automation system components, wherein at least two of the plurality of individual operational systems are simultaneously active and share the at least two of the automation system components, and each of the plurality of individual operational systems elementally embodied in the integrated control engine is consolidated into a single computer system.

2. The system of claim 1, wherein the integrated control engine further comprises:

a user interface that employs communication assets from an equipment engine, a processor, and memory.

3. The system of claim 2, wherein the memory includes non-volatile memory, which maintains information even if power is suspended.

4. The system of claim 2, wherein the user interface further comprises:

a cabinet physically sized and dimensioned to fit in a primary control station.

5. The system of claim 4, wherein the user interface further comprises:

a video display, a control engine interaction device, and a manual equipment engine control.

6. The system of claim 2, wherein the user interface further comprises:

a cabinet physically sized and dimensioned to fit in an area typically occupied by a driller's desk.

7. The system of claim 6, wherein the user interface further comprises:

a video display, a control engine interaction device, and a manual equipment engine control.

8. The system of claim 1, wherein the individual operational systems each comprises at least one of:

an equipment condition system, a directional steering system, an electronic choke system, a drilling pressure system, a mud pump control system, a kill sheet system, a daily reporting system, a safety analysis and report system, a traveling equipment position system, a top drive position system, a pipe handler system, a floor wrench system, a remote access system, an autodriller system, a rig drilling data system, a pit volume totalizer system, a mud gas system, a mud flow system, a mud density system, a rig video system, an automated tubular racking system, a casing running system, a BOP control system, a pipe centralizing arm system, a drawworks system, a coiled tubing unit system, and a slips system.

9. The system of claim 1, wherein the individual operational systems function independently of one another.

10. The system of claim 1, wherein the integrated control engine is adapted to send to and receive information from a plurality of the integrated sensor engine, integrated equipment engine, and integrated report engine.

11. The system of claim 1, wherein the integrated control engine is adapted to transmit information to and from each of the integrated sensor engine, integrated equipment engine, and integrated report engine.

12. A method for augmenting a traditional rig with an automation system, comprising:

installing an integrated control engine system;

installing communication link capacity to send and receive information between the integrated control engine system and a plurality of components of the automation system;

installing an integrated sensor engine;

installing an integrated equipment engine; and simultaneously activating at least two of a plurality of selectable individual operational systems, each of which is elementally embodied in the plurality of the components of the automation system, wherein the at least two of the plurality of selectable individual operational systems share the plurality of the components of the automation system, and each of the plurality of selectable individual operational systems elementally embodied in the integrated control engine system is consolidated into a single computer system.

13. The method of claim 12, wherein installing the integrated control engine comprises:

installing a user interface that employs communication assets from an equipment engine, a processor, and memory.

14. The method of claim 13, wherein the memory includes non-volatile memory, which maintains information even if power is suspended.

15. The method of claim 13, wherein installing a user interface further comprises:

installing a cabinet physically sized and dimensioned to fit in a primary control station; and installing the control engine in the cabinet.

16. The method of claim 15, wherein installing a user interface further comprises:

installing a video display, a control engine interaction device, and a manual equipment engine control in the cabinet.

17. The method of claim 13, wherein installing a user interface further comprises:

removing a driller's desk; and installing a cabinet physically sized and dimensioned to fit in an area formerly occupied by the driller's desk.

18. The method of claim 17, wherein installing a user interface further comprises:

installing a video display, a control engine interaction device, and a manual equipment engine control in the cabinet.

19. The method of claim 12, wherein activating selectable individual operational systems dynamically includes selecting at least one of an equipment condition system, a directional steering system, an electronic choke system, a drilling pressure system, a mud pump control system, a kill sheet system, a daily reporting system, a safety analysis and report system, a traveling equipment position system, a top drive position system, a pipe handler system, a floor wrench system, a remote access system, an autodriller system, a rig drilling data system, a pit volume totalizer system, a mud gas system, a mud flow system, a mud density system, a rig video system, an automated tubular racking system, a casing running system, and a BOP control system.

20. The method of claim 12, wherein the individual operational systems function independently of one another.

21. A method for augmenting a traditional rig with an automation system, comprising:

installing an integrated control engine system, which comprises:

a user interface that employs a communication link capacity from an integrated equipment engine, which comprises: a cabinet physically sized and dimensioned to fit in an area formerly occupied by a driller's desk;

a processor; and memory;

wherein the communication link capacity sends and receives information between one or more components of the automation system;

installing an integrated sensor engine;

installing the integrated equipment engine; and simultaneously activating at least two of a plurality of selectable individual operational systems, wherein the at least two of the plurality of selectable individual operational systems share at least one of the integrated control engine system, the integrated sensor engine, and the integrated equipment engine, and each of the plurality of selectable individual operational systems sharing the integrated control engine system is consolidated into a single computer system.

22. The method of claim 21, wherein installing a user interface further comprises:

removing the driller's desk prior to installing the cabinet.

23. The system of claim 21, wherein the user interface further comprises:

a video display, a control engine interaction device, and a manual equipment engine control.

24. The method of claim 21, wherein the simultaneously activated individual operational systems function independently of one another.

25. An apparatus comprising:

a control system physically sized to fit within a predetermined space on one of a drilling rig and a workover rig, the control system having circuitry that includes:

an interface section configured to electrically cooperate with each of a plurality of different subsystems that can be present on a rig;

memory storing a plurality of different program modules adapted to simultaneously activate at least two of a plurality of selectable independent operational systems when executed, wherein the selectable independent operational systems, when executed, share at least one of the control system, a sensor engine, and an equipment engine, and each of the plurality of selectable independent operational systems sharing the control system is consolidated into a single computer system, wherein the control system comprises a plurality of components that send information to and from each other; and a processor that is adapted to cooperate with the interface section and with the memory, and that execute a selected set of the program modules.

26. An apparatus according to claim 25, wherein the circuitry further includes a user interface that employs communication assets from an equipment engine through which a user can specify the selected set of program modules.

27. An apparatus according to claim 25, wherein the memory includes non-volatile memory, which maintains information even if power is suspended, and including a further program module that is stored in the memory and that, when executed by the processor, interacts with each of the program modules in the selected set.

28. An apparatus according to claim 27, wherein the circuitry includes a display, and wherein the further program module, when executed by the processor, has an operational mode in which it simultaneously presents on the display a plurality of elements of information that are respectively obtained from respective different program modules in the selected set.

29. An apparatus according to claim 25, wherein the predetermined space is a space configured to receive a driller's desk.

* * * * *